US009517850B2

(12) United States Patent
Zagnoni et al.

(10) Patent No.: US 9,517,850 B2
(45) Date of Patent: Dec. 13, 2016

(54) ROTATING TUCKING DEVICE FOR A SINGLE ROLL WRAPPER SYSTEM

(71) Applicant: Infinity Machine & Engineering Corp., De Pere, WI (US)

(72) Inventors: Christian Zagnoni, Calcara di Crespellano (IT); Todd Lee Hanson, Luxemburg, WI (US); Scott Santaga, Green Bay, WI (US)

(73) Assignee: Infinity Machine & Engineering Corp., De Pere, WI (US)

( * ) Notice: Subject to any disclaimer, the term of this patent is extended or adjusted under 35 U.S.C. 154(b) by 658 days.

(21) Appl. No.: 13/944,615

(22) Filed: Jul. 17, 2013

(65) Prior Publication Data

US 2015/0020478 A1 Jan. 22, 2015

(51) Int. Cl.

| | |
|---|---|
| ***B65B 25/14*** | (2006.01) |
| ***B65B 51/00*** | (2006.01) |
| ***B65B 11/42*** | (2006.01) |

(52) U.S. Cl.

CPC ..... *B65B 25/146* (2013.01); *B65B 11/42* (2013.01); *B65B 51/00* (2013.01)

(58) Field of Classification Search

CPC ..... B65B 25/146; B65B 51/00

USPC ..... 53/370.6, 317.3, 371.5

See application file for complete search history.

(56) References Cited

U.S. PATENT DOCUMENTS

| | | | | |
|---|---|---|---|---|
| 2005/0060954 | A1* | 3/2005 | Dall'Omo | B65B 25/146 53/230 |
| 2011/0076128 | A1* | 3/2011 | Johnsen | B65G 21/14 414/791.6 |
| 2014/0260087 | A1* | 9/2014 | Antoniazzi | B65B 11/26 53/138.2 |
| 2015/0251785 | A1* | 9/2015 | Canini | B65B 25/146 53/209 |

FOREIGN PATENT DOCUMENTS

IT WO 2013054229 A1 * 4/2013 ..... B65B 11/26

OTHER PUBLICATIONS

Continuous Flow Wrappers, Paper Converting Machine Company, http://www.pcmc.com/mods-upgrades/tissuetowel/wrappers, accessed Jul. 12, 2013.

* cited by examiner

*Primary Examiner* — Michelle Lopez
*Assistant Examiner* — Chinyere Rushing-Tucker
(74) *Attorney, Agent, or Firm* — Andrus Intellectual Property Law, LLP

(57) ABSTRACT

A rotating tucking device for securing a wrapper to a roll in a roll packaging system comprises a tucking arm for insertion into a hollow cavity of a roll and a rotating insertion system connected to the tucking arm for moving the tucking arm in a rotational pattern coordinated with the movement of the roll through the roll packaging system such that the tucking arm and the rotating insertion system tuck a wrapper into the hollow cavity of the roll as the roll moves continuously through the roll packaging system. Also provided is a (Continued)

roll packaging system having a rotating tucking device, as well as a rotating tucking method for securing a wrapper to a roll as the roll moves continuously through the roll packaging system.

14 Claims, 13 Drawing Sheets

ROTATING TUCKING DEVICE FOR A SINGLE ROLL WRAPPER SYSTEM

FIELD

The present disclosure relates to a tucking device for use in a roll packing system wherein the tucking device allows for a wrapper to be secured to a roll during the packaging process.

BACKGROUND

Rolls of product, for example, rolls of household tissue, e.g., toilet paper or paper towel, need to be packaged for distribution and commercial sale. Many rolled products, including rolls of household tissue, are individually wrapped in packaging, such as paper or plastic. Oftentimes, the wrapped individual rolls are then packaged in groups in larger packaging, such as larger plastic bags, boxes, etc.

Wrapping individual rolls in packaging requires special manufacturing equipment, specifically, roll packaging systems. Many roll packaging systems package rolls by wrapping them and then securing the wrapper to the roll by tucking the wrapper into the hollow center cavity of the roll. Tucking is generally accomplished by forcing the wrapper into the center of the roll with a tucking device, such as a rod sized to fit within the center of the roll that pushes any paper covering the center portion of the roll into that hollow center cavity.

Prior art roll packaging methods contemplate multiple stages wherein the roll is moved from station to station and each stage is completed while the roil is in a stationary, or stopped, position. Prior art roll wrapping systems typically have a step wherein a wrapper is folded at least partially over a roll, while the roll is stationary, and then, after the folding process occurs, a stationary tucking arm is pushed into the hollow cavity of the roll to tuck the folded wrapper into the hollow cavity to secure the wrapper to the roll. In these prior art devices, the roll remains stationary throughout the first folding and tucking step. After the first folding step, the roll is then moved along the assembly in the roll wrapping system to several more stationary locations wherein the remainder of the wrapper is folded over the roll and then tucked into the center of the roll. Once the tucking step is completed. the packaging system moves the roll to the next station.

For example, many prior art tucking devices feature a four station gradual folding and tucking method wherein the wrapper was folded over each of the top, bottom, left, and right sides of the roll end. At each of the four tucking stages, the wrapper is plunged into the core with a tucking device. In prior art systems, the roll is stopped to perform each tucking operation because prior art tucking devices operate to linearly drive a tucking arm, or rod, into the roll. Thus, prior art tucking devices operate along a single axis to make a simple in-out motion to plunge the tucking arm into the hollow center of the roll and then to remove the arm from the

SUMMARY OF INVENTION

Prior art roll packaging systems and methods described above are inefficient and can be improved by reducing the number of steps required to wrap a roll in packaging and/or by reducing the number of times that the roll has to be stopped in the packaging process. Specifically, by allowing the roll to continue moving through a roll wrapping system while the tucking process takes place and/or by combining two or more of the wrapping steps together into one continuous process efficiency is greatly increased. This increased efficiency manifests itself in an improved machine having a smaller footprint and occupying less space on a manufacturing floor.

Whereas prior art tucking machines used to have separate, stationary folding steps and tucking steps, the present invention contemplates folding and tucking in one continuous step while the roll continues moving through the roll wrapping system. A rotating tucking arm allows the roll to continue moving in the packaging system while the wrapper is tucked into the center of the roll. The rotating tucking device works to capture and tuck more of the wrapper into the roll in one tucking action. Thereby, the disclosed rotating tucking device and method reduces the number of steps required to tuck a wrapper into the hollow cavity of a roll and reduces the amount of time that those steps take because they can be accomplished simultaneously as the roll continues its motion through the packaging system. Specifically, by changing the tucking process from the stationary process of the prior art to the rotational, or moving, process of the present invention, throughput of the roll wrapping system increases by roughly fifty rolls per minute. The footprint of the roll wrapping system is reduced because the fewer tucking steps are performed in less amount of space. As space and time are both important factors in profitability in a manufacturing environment, the increase in manufacture speed and reduced footprints of the roll wrapping system including the present invention can provide a great benefit to a manufacturer leading to increased profits.

in one embodiment, a rotating tucking device for securing a wrapper to a roll in the roll packing system comprises a tucking arm and a rotating insertion system. The tucking arm is designed for insertion into a hollow cavity of a roll The rotating insertion system is connected to the tucking arm and moves the tucking arm in a rotational pattern coordinated with the movement of the roll in the roll packaging system such that the tucking arm and the rotating insertion system tuck a wrapper into the hollow cavity of the roll as the roll moves continuously to the roll packaging system.

In another embodiment, a method for securing the wrapper to a roll comprises providing a roll to a roll packaging system, the roll having a tubular body with a first end and a second end and hollow cavity running therethrough, and then moving the roll through the roll packaging system. The method also includes placing a wrapper at least partially around the outer circumference of the roll, folding the wrapper over a portion of the first end of the roll such that an edge of the wrapper extends over the hollow cavity of the roll, and then inserting a tucking arm into the hollow cavity of the roll to push the edge or the wrapper into the hollow cavity in order to secure the wrapper to the roll. The moving step and the inserting step are coordinated in speed and direction such that the wrapper is secured to the roll while the roll moves continuously through the roll packaging system.

In yet another embodiment, a roll packaging system comprises a roll conveyor, a wrapping apparatus, a first folding apparatus, and a first rotating tucking device. The roll conveyor moves the roll through a roll packaging system, the roll having a tubular body with a first end, a second end, and a hollow center cavity running therethrough. The wrapping apparatus is operationally connected to the roll conveyor for covering at least a portion of the roll with a wrapper. The first folding apparatus is operationally connected to the roll conveyor and is positioned adjacent to the wrapping apparatus for folding the wrapper over the first end of the roll such that an edge of the wrapper extends over the hollow center portion of the roll. The first rotating tucking device is operatively adjacent to the roll conveyor for securing the wrapper to the roll by tucking the edge of the wrapper into the hollow center cavity as the roll moves continuously on the roll conveyor. Specifically, the rotating tucking device includes a tucking arm and a rotating insertion system connected to the tucking arm and moving the tucking arm in a rotational pattern, wherein the rotational pattern is coordinated with the movement of the roll on the roll conveyor such that the rotating insertion system inserts the tucking arm into the hollow center cavity of the roll as the roll moves continuously along the roll conveyor.

Various other features, objects and advantages of the invention will be made apparent from the following description taken together with the drawings,

BRIEF DESCRIPTION OF THE FIGURES

The drawings illustrate the best mode presently contemplated of carrying out the disclosure. In the drawings:

FIG. 1A illustrates a rotating tucking device beginning a tucking action. FIG. 1B is a schematic illustration of the rotating tucking device of FIG. 1A shown in the middle of a tucking action. FIG. 1C is a schematic illustration of the rotating tucking device of FIG. 1A near the end of the tucking action.

DETAILED DESCRIPTION OF THE DRAWINGS

Figure 1A:
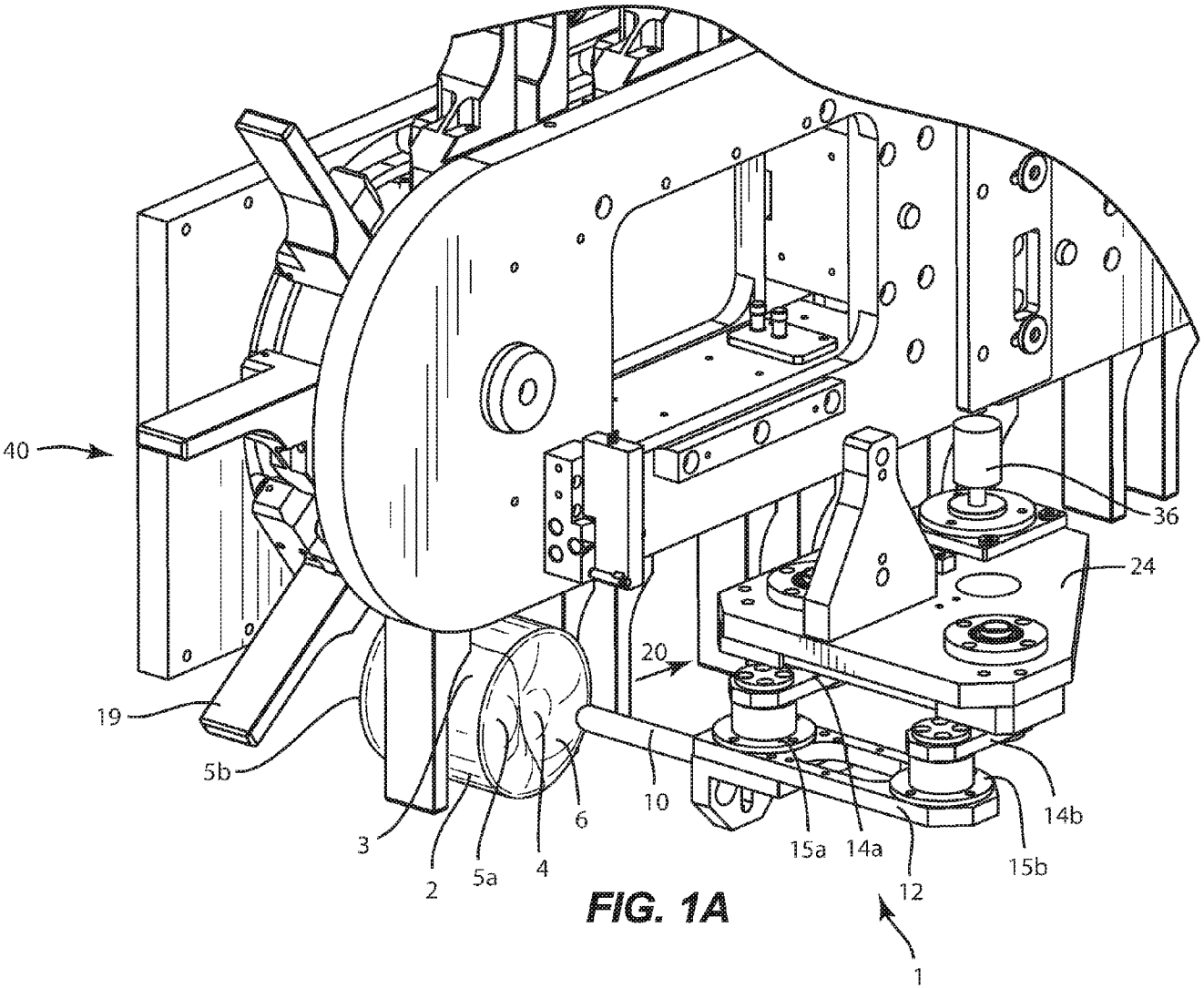
FIGS. 1A-1C provide a schematic illustration of an embodiment of a rotating tucking device performing a tucking action.

In the present description, certain terms have been used for brevity, clarity, and understanding. No unnecessary limitations are to be implied therefrom beyond the requirements prior art because such terms are used for descriptive purposes only and are intended to be broadly construed. The different systems and methods described herein may be used alone or in combination with other systems and methods. Various equivalents, alternatives, and modifications are possible within the scope of the appended claims.

Referring to FIG. 1, a roll wrapping system 40 is depicted wherein a roll 2 is wrapped with a wrapper 6. The roll 2 has a tubular body portion 3 with two opposed ends 5, including a first end 5*a* and a second end 5*b*, and a hollow center portion or cavity 4 extending therethrough. The roll may be held by fingers 19 that steady the roll 2 and propel it through the roll wrapping system 40. The roll 2 follows the roll path 20 through the roll wrapping system 40, where the roll 2 is covered entirely in the wrapper 6 and the wrapper 6 is secured to the body of the roll 2. The wrapper 6 is folded around the roll 2 and tucked into the hollow cavity 4 via a system containing, for example, a mixture of servo-driven moving devices and fixed folding guides to accomplish a consistent and reliable package wrap.

Figure 1B:
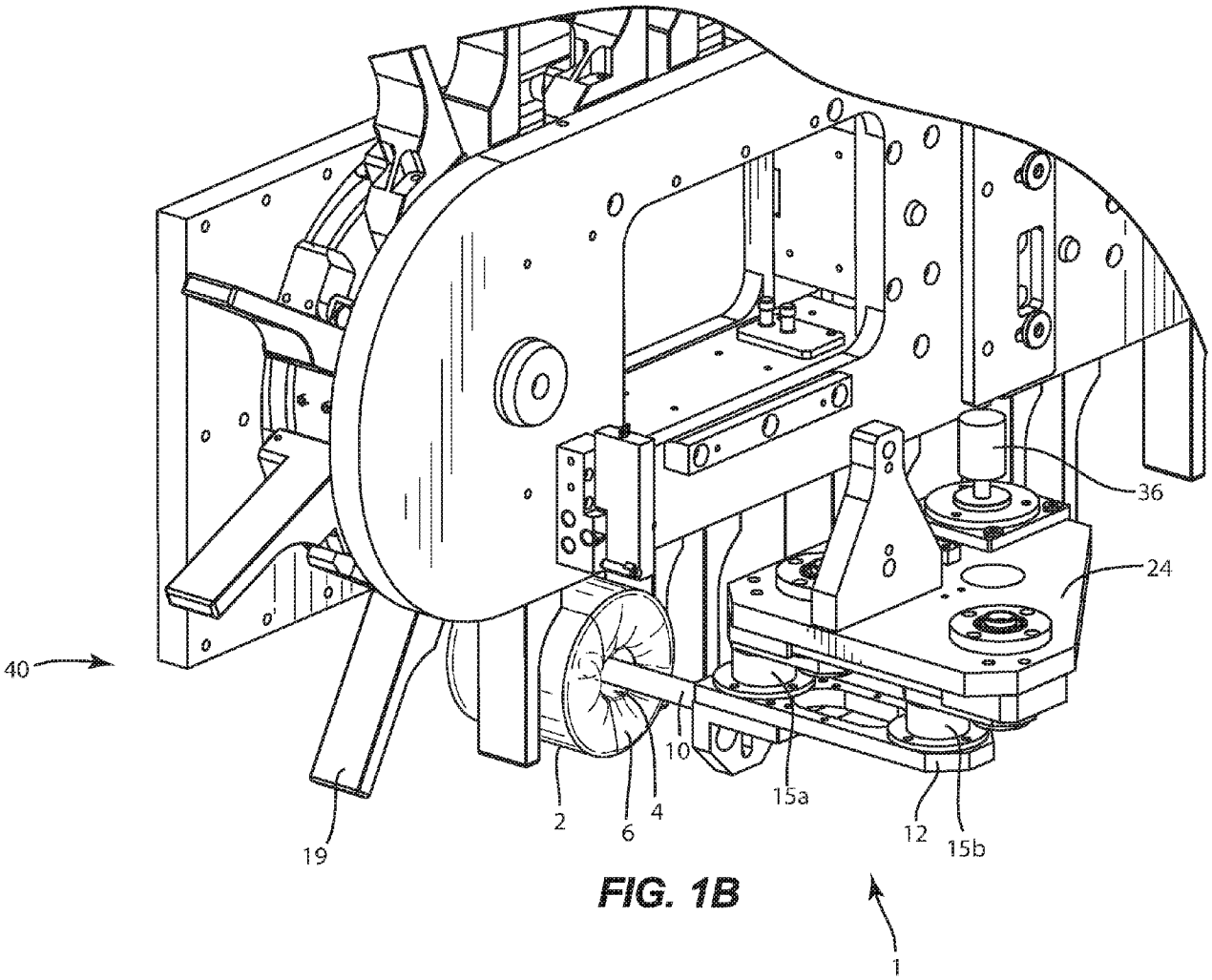
Figure 1C:
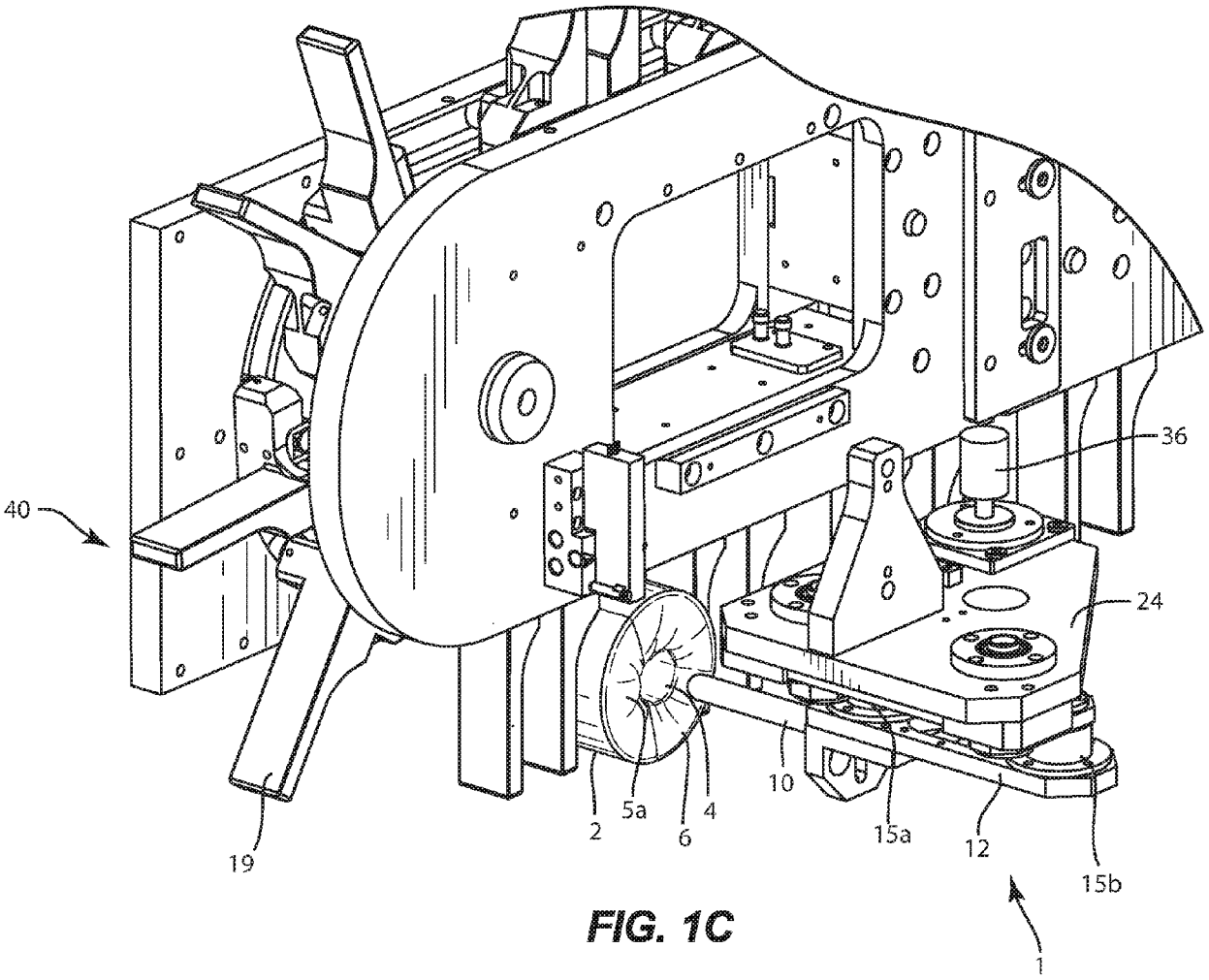

As depicted in FIGS. 1A-1C, and also in FIGS. 4A-4F, the roll 2 is covered in a wrapper 6 and then the wrapper 6 is secured to the roll 2 by tucking the wrapper 6 into the hollow cavity 4 of the roll 2. The wrapper 6 is tucked into the hollow cavity 4 by one or more tucking devices, including a rotating tucking device 1. In the embodiment depicted in FIGS. 1A-1C, the rotating tucking device I is positioned adjacent to an end 5 as the roll 2 is traveling through the roll wrapping system 40 along roll path 20. The rotating tucking device 1 operates to tuck the wrapper 6 into the hollow cavity 4 of the roll in order to secure the wrapper 6 to the roll The rotating tucking device 1 performs the tucking action while the roll 2 continues its movement along the roll path 20. The rotating tucking device 1 performs a moving tucking step wherein the tucking arm 10 is inserted into the hollow center portion or cavity 4 of the roil 2 when the wrapper 6 is folded over and is covering the hollow cavity 4. The tucking arm 10 pushes the edges of the wrapper 6 into the hollow cavity 4, folding the edges into the hollow cavity 4 and securing the wrapper to the roll 2. In some embodiments, the roll wrapping system 40 includes a rotating tucking device 1 on each side of the roll 2 in order to tuck the wrapper 6 into the hollow cavity 4 at each of the first roll end 5*a* and the second roll end 5*b*. Specifically, a first rotating tucking device 1 may be positioned adjacent to the first end 5*a* of the roll 2, and an opposing rotating tucking device 69 may be positioned adjacent to the second end 5*b* of the roll. As depicted in Fig, 6, two rotating tucking devices may work simultaneously, both inserting their respective tucking arms 10 into both ends 5*a* and 5*b* of the roll 2 at the same time. Alternatively, the rotating tucking devices 1 and 69 could operate sequentially to tuck the wrapper 6 into each of the ends 5*a* and 5*b* one at a time.

The rotating tucking device 1, in one embodiment, has a tucking arm 10 connected to a support bar 12. The support bar 12 is connected to at least one crank 14 by a rotating joint 15. The crank 14 is connected to a drive system 23 that rotates the crank 14 in a circular motion, driving the support bar 12 and the tucking arm 10 in a rotational pattern 17. As seen in FIG. 2, the rotating insertion system 9 may be a four-bar linkage system having, for example, two cranks 14*a* and 14*b*. The front crank 14*a* may be connected to the support bar 12, for example, by a front rotating joint 15*a*. Likewise, the rear crank 14*b* may be connected to the support bar 12 by a rear rotating joint 15*b*. The cranks 14*a* and 14*b* are then connected to a drive system 23 which drives the cranks in a circular motion, in turn causing the support bar 12 to execute a circular motion.

Figure 2B:
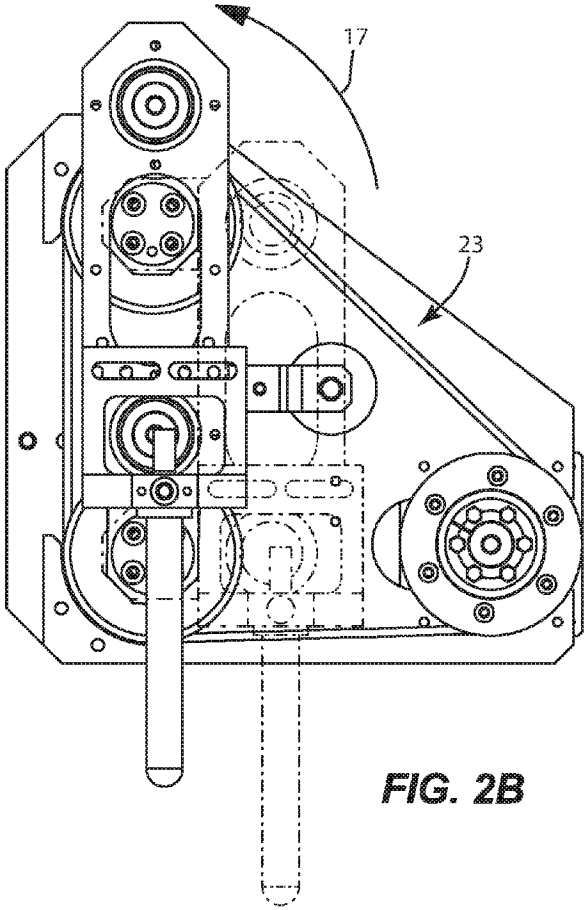
FIGS. 2A and 2B depict an embodiment of the rotating tucking device from a bottom angle.
Figure 2A:
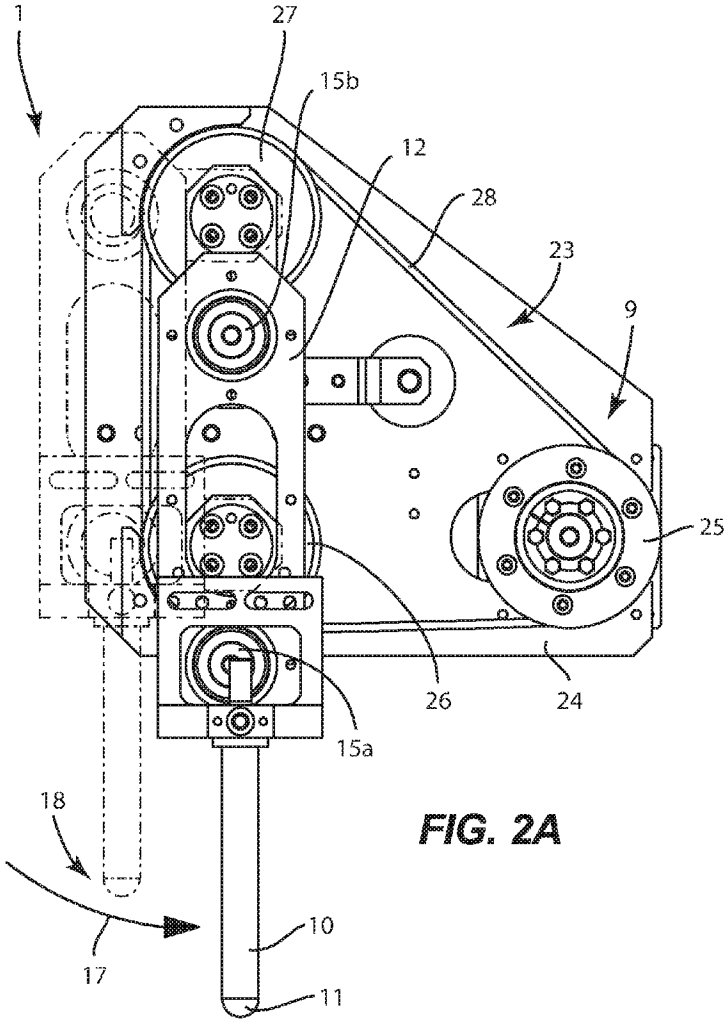

As shown in FIGS. 2A and 2B, an embodiment of the drive system 23 has three pulleys connected by a driver belt 28 to drive the tucking arm 10 and support bar 12 in the rotational pattern 17. In the embodiment of FIG. 2, the pulleys 25-27 are connected to a support plate 24. The support plate 24 may be positioned above the drive system 23, with the driver pulleys 25-27 attached to the support plate 24 and the drive system 23 located below the support plate 24. One driver pulley 25 may be connected by the driver belt 28 to two driven pulleys 26 and 27. As depicted, the driver pulley 25 and driven pulleys 26 and 27 may be connected to the support plate 24 in a triangular pattern, thereby causing the driver belt 28 to form a triangular shape. In such an embodiment, the driver pulley 25 may be situated adjacent to the driven pulleys 26 and 27 so that the driver pulley 25 can drive the driven pulleys 26 and 27. The driver pulley 25 may be connected to a motor 36, which creates the rotational force for the drive system 23. The driver pulley 25 may be connected by the driver belt 28 to the front driven pulley 26 and the rear driven pulley 27, allowing the driver pulley 25 to drive the driven pulleys 26 and 27. The driven pulleys 26 and 27, in turn, drive the front crank 14*a* and the rear crank 14*b*. The front rotating crank 14*a* and the rear rotating crank 14*b* work to push the support bar 12 in a circular motion such that the support bar 12 maintains a front facing orientation throughout the rotational pattern 17.

While the above description discloses the preferred best mode, the rotating insertion system 9 may be any system capable of driving the tucking arm 10 in a rotational pattern wherein at least a portion of the rotational pattern corresponds with the speed and direction of the roll 2 moving through a roll wrapping system 40. For example, with reference to FIGS. 1 and 2, the drive system may alternatively be comprised of only one pulley 25 that is directly connected to a crank 14 which could propel the support bar 12 and tucking arm 10 directly. In still other embodiments, the drive system 23 may include a driver pulley 25 and a single driven pulley, wherein the driver pulley 25 drives the driven pulley by a driver belt 28. The rotating insertion system 9 may further alternatively be any system capable of driving the tucking arm 10 in a pattern that enables the tucking arm 10 to tuck the wrapper 6 into the hollow cavity 4 of the roll 2.

The rotating insertion system 9 is driven by a controller, which may be the controller for the roll packaging system 40, or may be a separate controller for the rotating tucking device 1. The controller may be a programmable logic controller (PLC) device, or any controller known to one of skill in the art. For example, in a preferred embodiment, a single PLC controls the entire roll packaging system 40, and thus coordinates the movement between the various components of the system, including coordinating movement of the rotating insertion system 9 with the speed and position of the roll 2.

Figure 3:
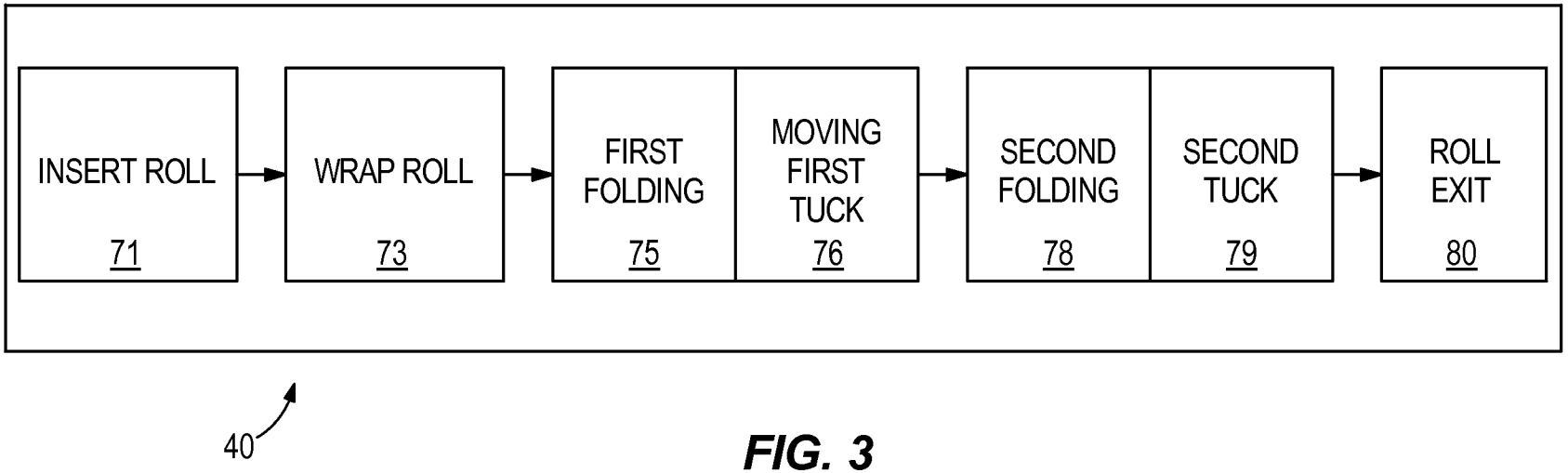
FIG. 3 depicts a flow chart of an embodiment of the method executed by a roll packaging system including a rotating tucking step.

In one embodiment, the rotating tucking device 1 causes the tucking arm to form a rotational pattern 17 that is circular in shape. As depicted in FIG. 3, the tip 11 of the tucking arm 10 follows a pattern 17 that has a start position 18 adjacent to the side of the roll. The speed of the rotating tucking device 1 is timed such that the tucking arm 10 enters the hollow cavity 4 of the roll as the roll is moving along path 20, and does so without bumping the body of the roll 2 or otherwise disturbing the position of the roll in the fingers 19. At the starting point 18, the roll is positioned to enter the hollow cavity 4 of the roll 2. Then, as the tucking arm is propelled along the rotational pattern 17, the tucking arm 10 enters the hollow cavity 4 of the roll 2. The tucking arm 10 enters the hollow center with making minimal or no contact with any walls of the hollow cavity 4. After the tucking arm 10 enters the hollow cavity 4, the tucking arm travels along the circular rotational pattern 17 depicted in FIG. 3, wherein it is plunged further into the hollow cavity 4 of the roll to fully tuck the wrapper, e.g. the edge 31, into the center of the roll. Thereafter, following the circular rotational pattern 17, the tucking arm 10 is removed from the hollow cavity 4 of the roll and returned to its start position 18 so that it may tuck a subsequent roll. Preferably, rotating tucking device 1 does not stop at the start position 18 but continues right on into the next tucking step making makes a continual rotational pattern 17.

The rotational pattern 17 is a function of the structure of the rotating tucking device 1. The present invention contemplates any rotational pattern 17 that can be created from a rotational tucking device 1 constructed by any means described above, or according to any technology known in the art. The rotational pattern 17 could be a pattern of any shape that would allow the rotating tucking device 1 to tuck the wrapper 6 into the hollow cavity 4 of the roll 2 while it moves through the roll wrapping system. For example, the rotational pattern 17 could be a rectangular or squarish pattern having a first side, a second side, third side, and fourth side. In such an embodiment, when the tucking arm 10 travels along the first side of the rotational pattern 17, it is propelled into the hollow cavity 4 of the roll 2. The tucking arm 10 then follows onto the second side of the rotational pattern 17 wherein it may be propelled at roughly the same speed and direction as the roll 2 moving through the roll wrapping system 40. When traveling along the third side of the rotational pattern 17, the tucking arm may be removed from the hollow cavity 4 of the roll 2. Finally, the tucking arm 10 traveling along the fourth side the rotational pattern 17 returns the tucking arm 10 to its start position. In still other embodiments, rotational pattern created by the insertion system 9 could be any shape, including but not limited to ovular or triangular, so long as the rotational pattern followed by the tucking arm 10 allows for the device to tuck a wrapper 6 into the hollow cavity 4 of the roll 2 as the roll is moving through the wrapping system 40.

The roll wrapping system 40 may include a single rotating tucking device, as demonstrated in FIGS. 1A-1C. Alternatively, the roll wrapping system 40 may execute a two-step tucking method, wherein a rotating tucking device 1 performs a moving first tucking step 76 and a second, or downstream, tucking device 54 performs a second tuck step 58. As depicted in the flowchart in FIG. 3, the roll wrapping system 40 may perform a wrapping process having two folding and tucking steps. In still other embodiments, the roll wrapping system 40 may execute a three-step or a four-step tucking method.

FIG. 3 demonstrates one embodiment of the roll wrapping method performed by the roll wrapping system 40. The roll is inserted into the system at step 71. The roll is then covered in a wrapper at step 73. After that, the roll enters a first folding step 75 and a moving first tuck step 76, wherein the first folding step 75 and the moving first tuck step 76 may occur sequentially or simultaneously. Following the moving first tuck step 76, the roll 2 enters a second folding step 78 and a second tuck step 79. The second folding step 78 and the second tuck step 79 may be sequential or simultaneous. Furthermore, the second tuck step 79 may be a moving tuck step, similar to step 76, or it may be a stationary tuck step. Thus, the roll 2 may stop moving prior to the second tuck step 79. In the embodiment depicted in FIG. 3, the second tuck step 79 is a final step which secures the wrapper 6 to the roll 2. Thus, after the second tuck step 79, the roll exists 80 the roll wrapping system 40.

Figure 4A:
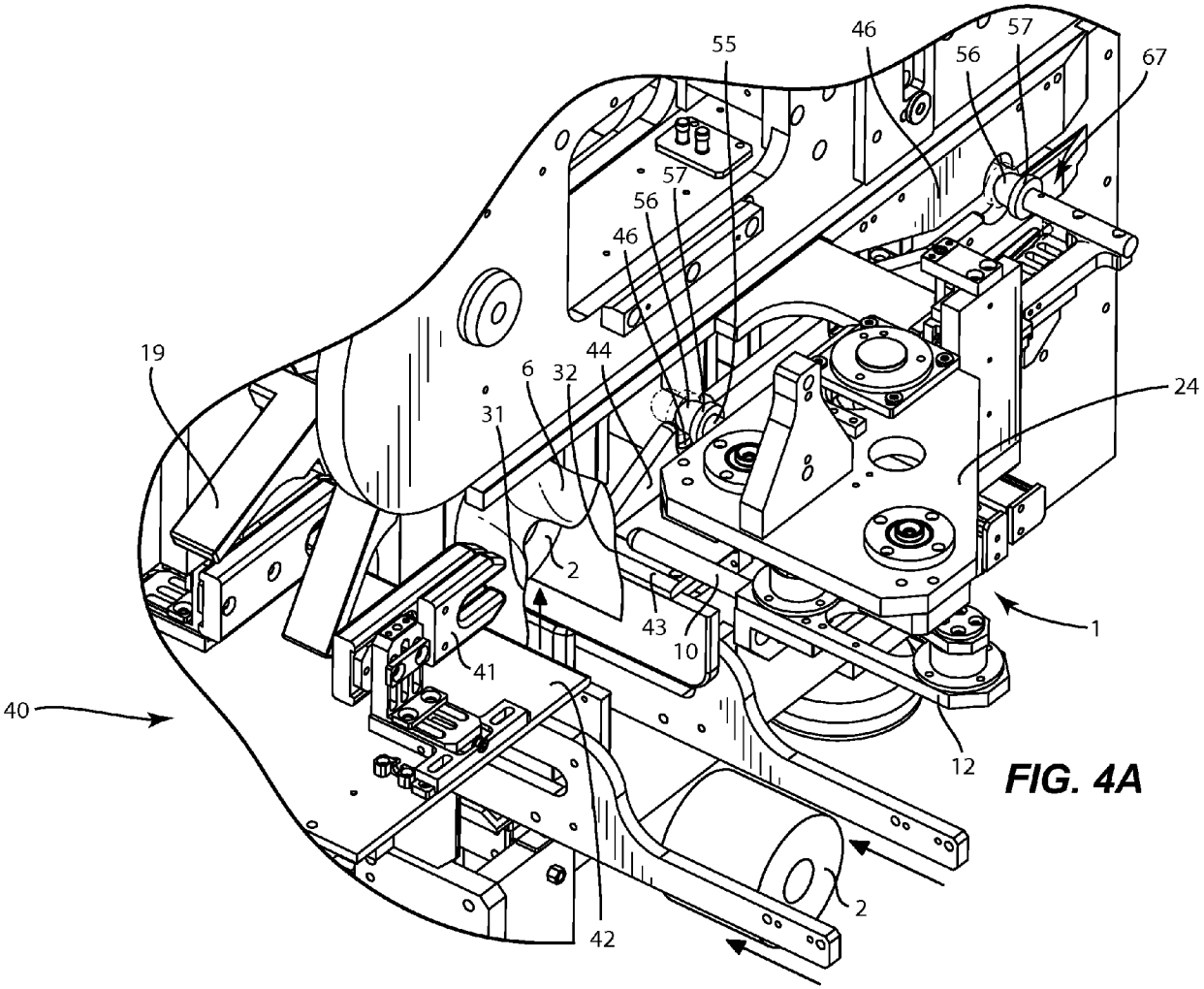
FIGS. 4A-4F depict an embodiment of a roll packaging system and method including a rotating tucking device and a three stationary tucking devices.
Figure 4B:
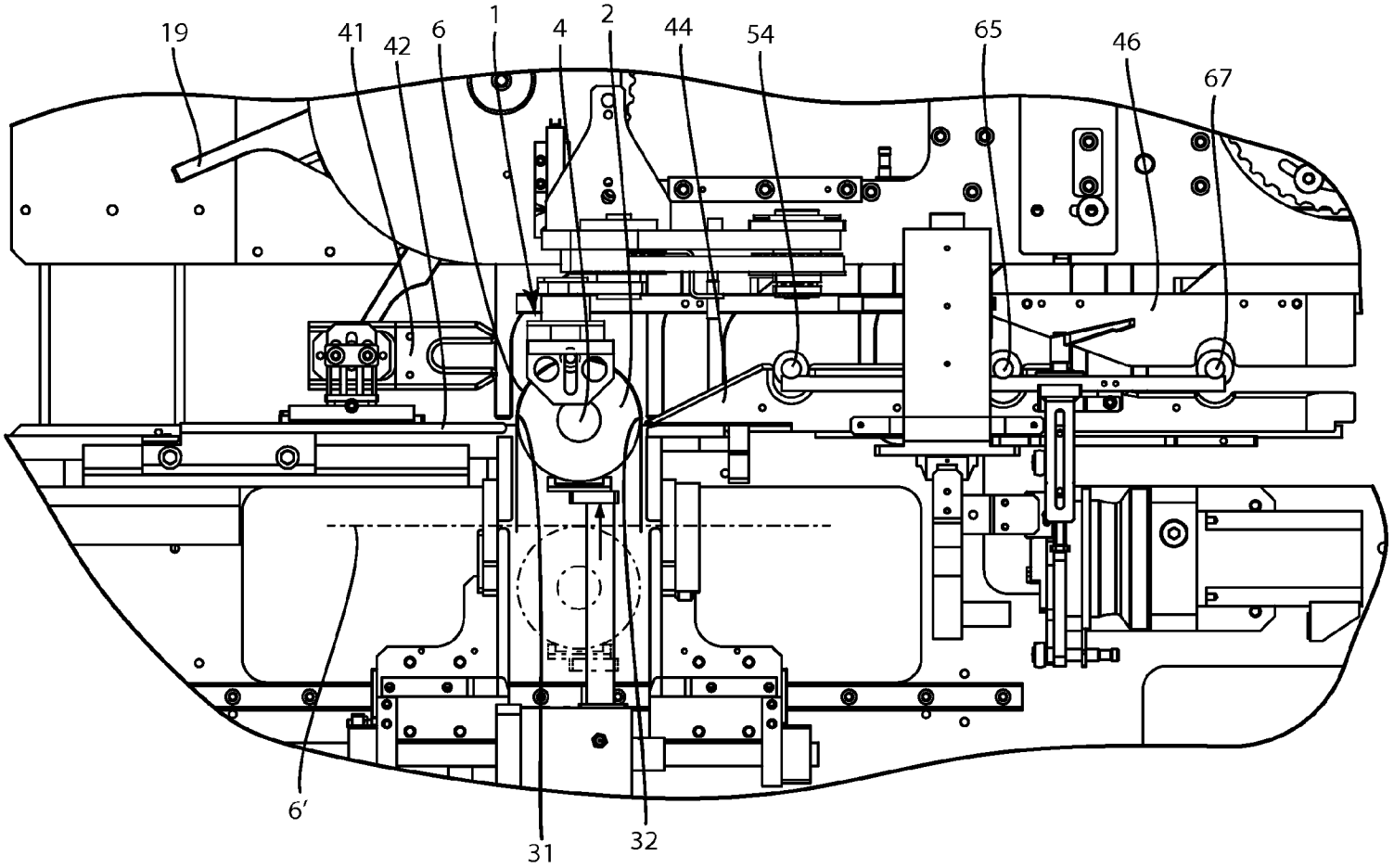
Figure 4C:
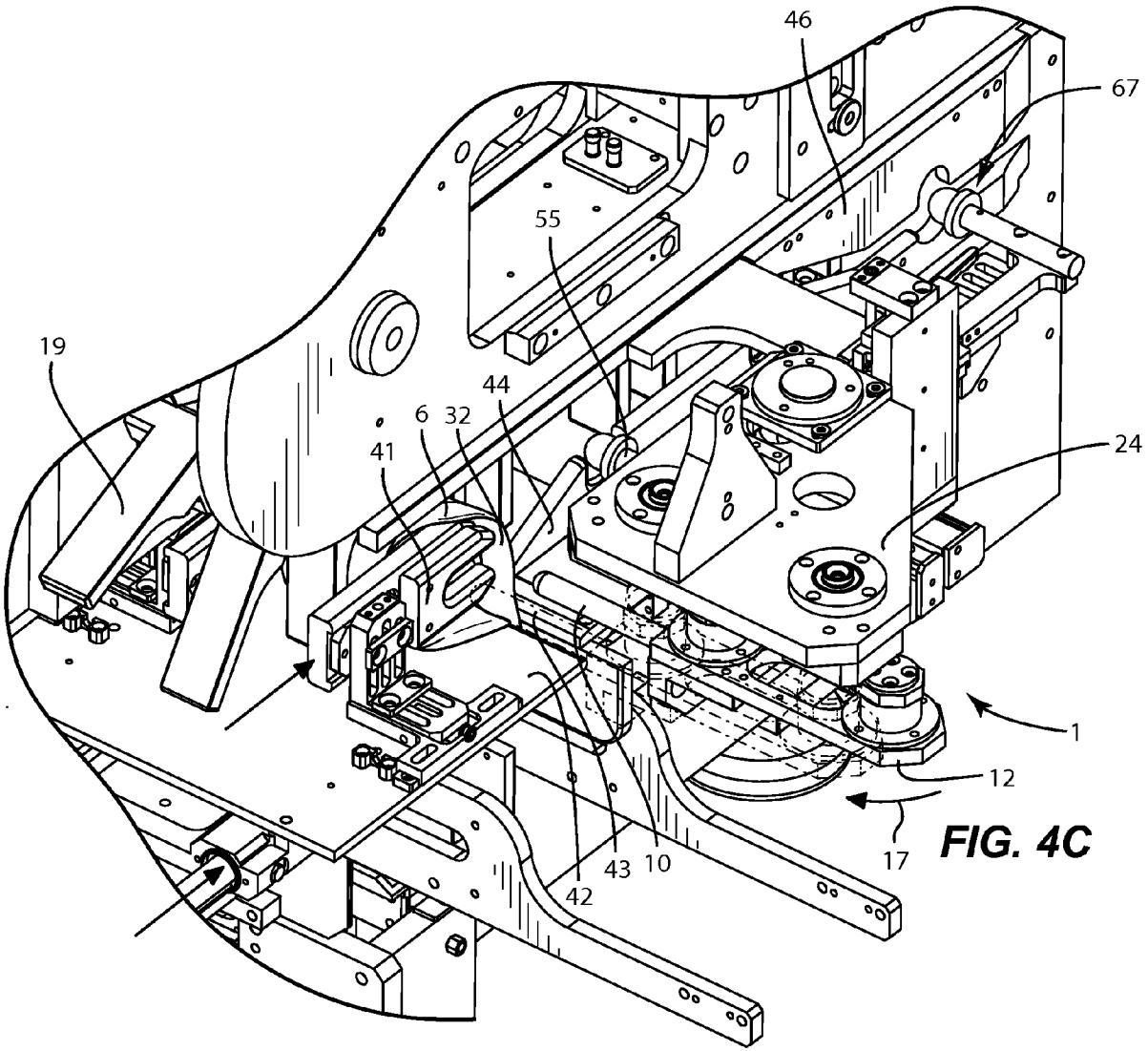
Figure 4D:
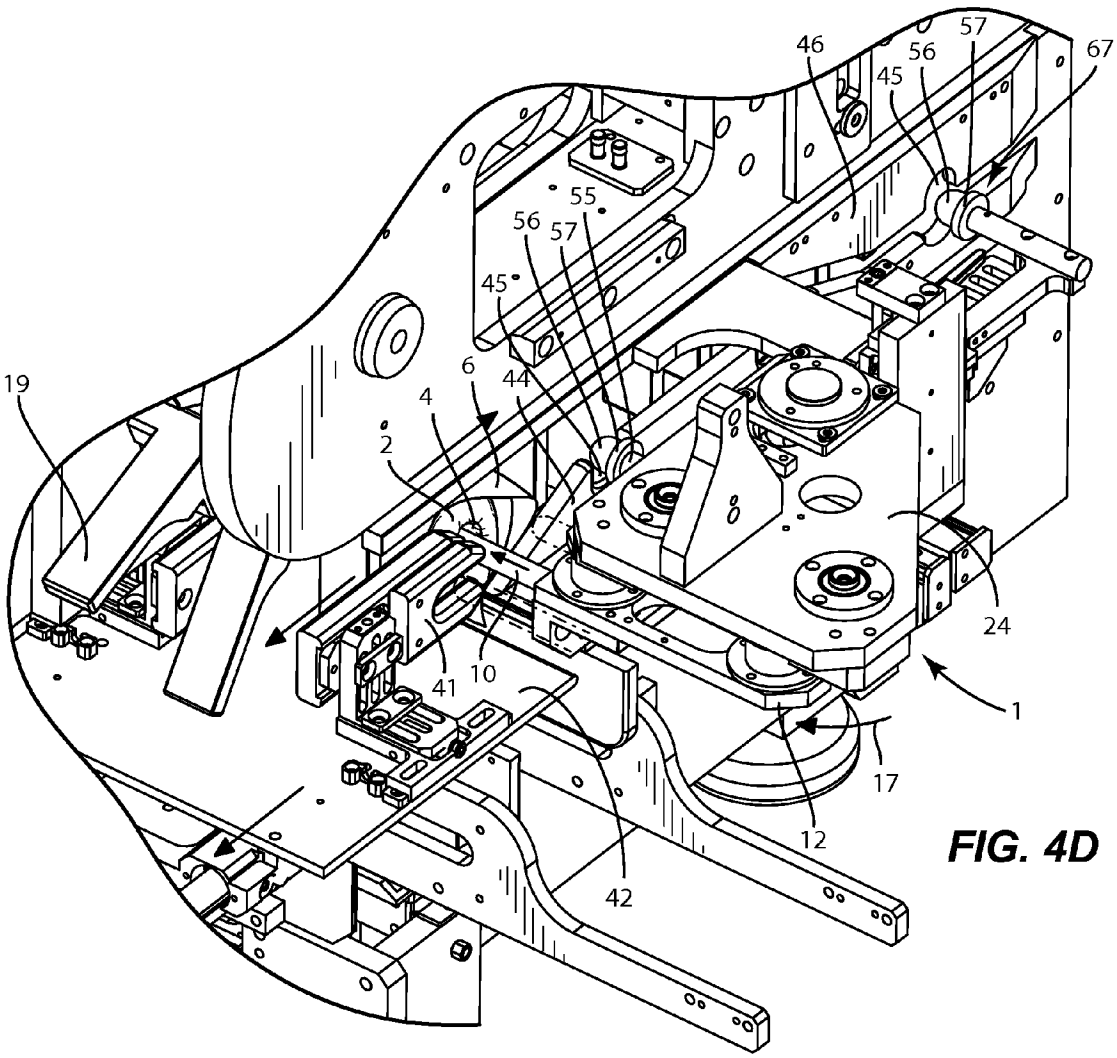
Figure 4E:
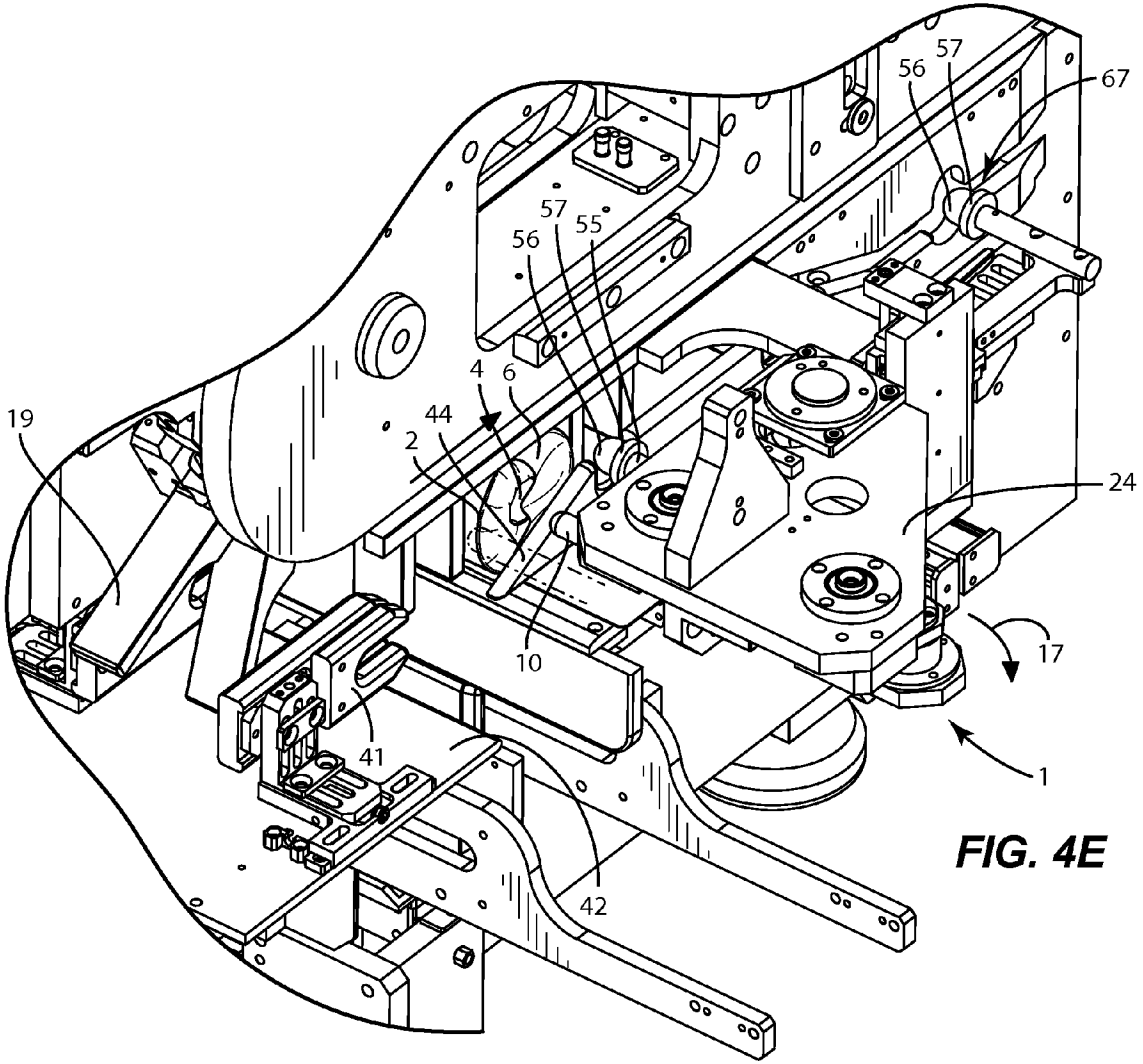
Figure 4F:
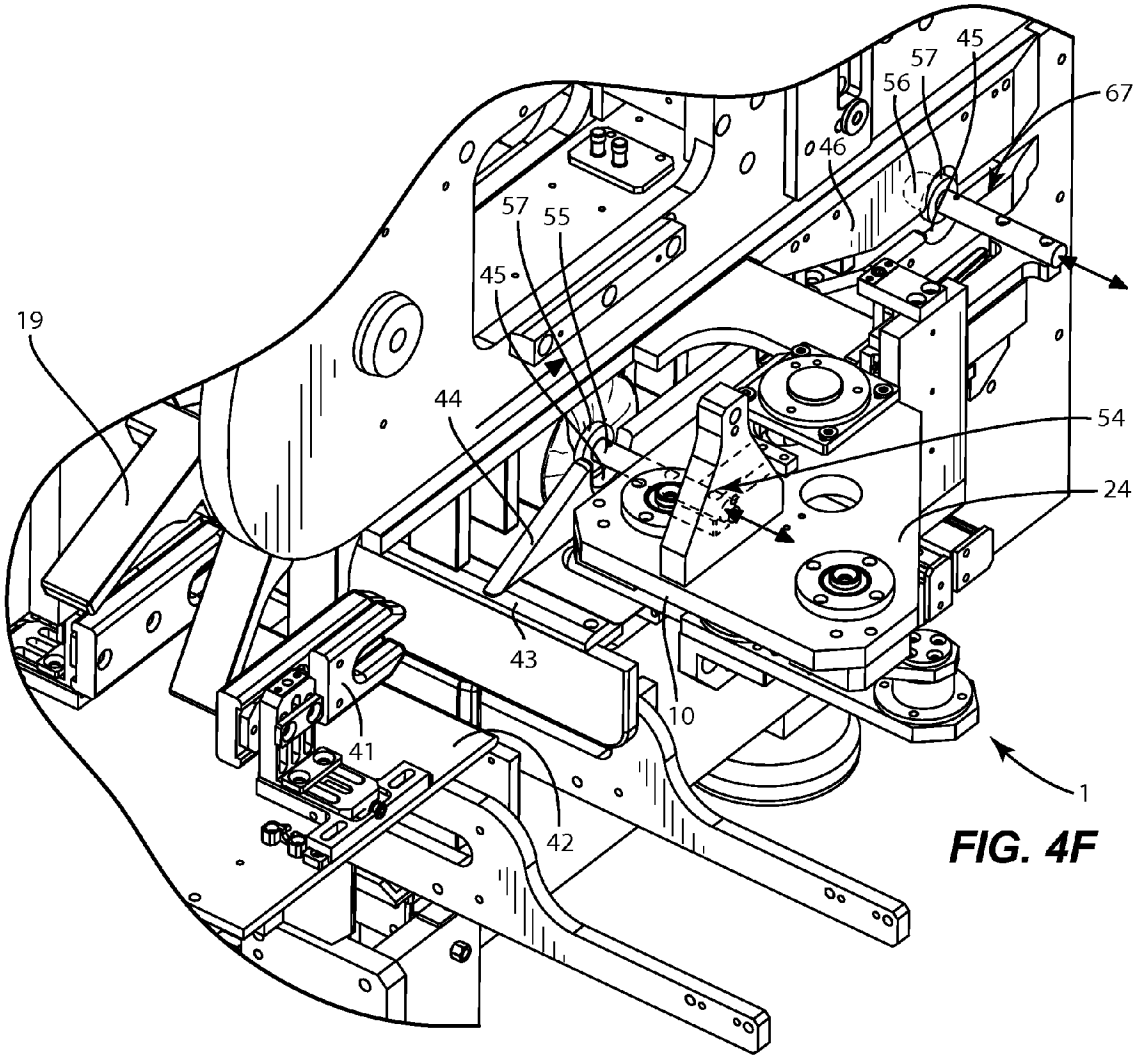

FIGS. 4A-4F demonstrate an embodiment of a method for securing a wrapper to a roll and a system for performing that embodiment of the method. In the depicted embodiment, the roll 2 is inserted into the roll wrapping system 40 in a first insertion step 71. The roll wrapping system 40 then wraps the roll 2 in a wrapper 6 at step 73. For example, as seen in FIGS. 4A-4B, the roll wrapping system may drape a rectangular-shaped paper wrapper over the roll 2 so that the wrapper 6 makes a U-shape over the roll 2 covering approximately half of the circumference of the roll 2 and having two ends that hang from the sides of the roll 2. In some embodiments, the roll 2 may be elevated upwardly into a stretched out wrapper 6 and then into fingers 19, thereby causing the wrapper 6' to drape over the roll 2 and the wrapper/roll pair to be grabbed by the fingers 19 so that the wrapper/roll pair can be moved through the remainder of the packaging system 40.

In the embodiment of FIG. 4, after the wrapper 6 is partially wrapped 73 onto the roll, the roll wrapping system 40 may perform a first folding step 75 wherein a portion of the wrapper 6 is folded over one end 5 of the roll 2. For example, as seen in FIG. 4A, in the first folding step 75 the wrapper may be folded over the end 5 of the roll 2 by a head folding plate 41 and a first bottom folding plate 42. For example, in the embodiment of the method depicted in FIGS. 4A-4F, a first bottom folding plate 42 comes under the roll 2 and pushes the end of the wrapper 6 over the bottom portion of the circumference of the roll 2. At the same time, ahead folding plate 41 moves towards the roll 2 and over the end 5 of the roll, thereby pushing the wrapper to fold the wrapper 6 over the end 5 of the roll. When the wrapper 6 is folded over the end 5 of the roll, the edge 31 of the wrapper 6 extends over the hollow cavity 4 of the roll.

The moving first tuck step 76 may overlap in time and/or space with the first folding step 75. As the folding plate 41 is folding the wrapper 6 over the end 5 of the roll, the first moving tucking step 76 may begin. As described above, the first moving tuck step is performed with a tucking arm 10 attached to the rotating insertion system 9. As shown in FIGS. 4A-4F, ahead folding plate 41 may be C-shaped to accommodate the tucking arm 10 that is inserted into the hollow cavity 4 of the roll to tuck the edge 31 of the wrapper into the roll while the head folding plate 41 is in the process of completing the first folding step 75. In some embodiments, the head folding plate 41 is shaped to avoid covering the hollow cavity 4 of the roll as it performs the first folding step 75 so that the tucking arm 10 can enter the hollow cavity 4 while the folding step is still underway. As further described above, the first folding step 75 and the moving first tuck step 76 take place while the roll is in motion moving through the roll wrapping system 40.

Still referring to FIG. 4, after the rotating tuck device 1 performs the moving first tuck step 76, the roll moves through the roll wrapping system 40 towards the area where the second folding step 78 takes place. As depicted in FIGS. 4B-4C, as the roll 2 moves through the roll wrapping system 40, it passes over a second bottom folding plate 43. This second bottom folding plate 43 pushes the wrapper 6 over the bottom portion of the roll 2, thereby completing the wrapping around the circumference of the roll 2. Simultaneously or sequentially, a tail folding plate 44 moves over the end 5 of the roll to fold a second side of the wrapper 6 over the end 5 of the roll. Thus, a second edge of the wrapper 32 covers the hollow cavity 4 of the roll.

The roll wrapping system 40 may comprise any number of folding plates. For example, as seen in FIGS. 4A-4F, one embodiment of the roll wrapping system 40 has ahead folding plate 41, a first bottom folding plate 42, a second bottom folding plate 43, a tail folding plate 44 and a top folding plate 46. In the depicted embodiment, the head folding plate 41 and the tail folding plate 44 are designed to fold the side portions of the wrapper 6 over the end of the roll. The first bottom folding plate 42 and the second bottom folding plate 43 push the wrapper 6 around the bottom portion of the circumference of the roll 2 so that the wrapper 6 entirely covers the tubular body 3 of the roll 2. Finally, the head folding plate 46 is designed to push the top end of the wrapper 6 over the roll end 5*a* or 5*b*.

Similar to the head folding plate 41 described above, the tail folding plate 44 may be shaped to accommodate the second tucking arm 55, as the second tuck step 79 may overlap in time and space with the second folding step 78. The tail folding plate may be a mirror image of the head folding plate, or it may be different in shape. For example, as depicted in FIGS. 4A-4F, the tail folding plate 44 may be a solid plate with one or more holes or divots 46 that accommodate one ore more tucking arms as they are inserted into the hollow center cavity 4 of the roll. The tail folding plate 44 depicted in FIGS. 4A-4F may be most useful in a roll wrapping system 40 having a stationary second tuck step. In another embodiment, the tail folding plate 44 may move over the end 5 of the roll 2 and may pause momentarily when the hole 46 is positioned over the hollow cavity 4 of the roll 2. At that point, the second tucking step may take place, and the second tucking arm 55 may be inserted through a hole 46 in the tail folding plate 44 into the hollow cavity 4 of the roll. In this instance, the tail folding plate 44 would not be retracted until after the second tuck arm 55 is removed completely from the hole 46.

The second tuck step 79 may be a moving tuck step similar to the moving first tuck step 76, or it may be a stationary tuck step. FIGS. 4A-4F depict an embodiment having a stationary second tuck step 79. Therein, the roll 2 travels through the rotation of the second folding step 78 and second tuck step 79. The roll then stops moving while the tail folding plate 44 is pushed over the end 5 of the roll and the second tucking arm 55 is inserted into the hollow cavity 4 of the roll 2. The second tucking arm may have a press end 56 at the tip 111 of the arm 10. The tip 62 of the press end 56 my be slightly wider than the tucking arm and be shaped to press the wrapper 6 against the inner walls of the hollow cavity 4 in order to better secure the wrapper 6 to the roll 2. The pressed end 56 may have a tip 57 that is wider than the tip 62 in order to press the wrapper firmly against the roll end 5 and make a more secure tuck.

In one embodiment, the second folding step 78 and the second tuck step 79 overlap in time and space in order to perform an efficient roll wrapping process. However, in alternative embodiments, the second folding step 78 may be completed entirely before the second tuck step 79. In still other embodiments, the second tuck step 79 may begin at the tail end of the second folding step 78, or at any point in time which would enable the second tuck step 79 to tuck the second edge 32 of the wrapper 6 into the hollow cavity 4 of the roll once it is folded over the roll end 5.

The roll wrapping system 40 may comprise any number of tucking devices, one or more of which may be a rotating tucking device 1. For example, FIGS. 4A-4F depict an embodiment having a stationary second tuck step 79, as well as stationary third tuck step and a stationary fourth tuck step. After completion of the second tuck step 79, the roll 2 travels to a subsequent point in the roll packaging system 40 wherein a fold step and a third tuck step are executed. In the third tuck step, a third tucking device 65 is inserted into the hollow cavity 4 to further tuck the wrapper 6. The roll 2 is then moved again in the roll packaging system 40 to a point where a fourth tucking device 67 is inserted into the hollow cavity 4 of the roll 2.

Figure 5:
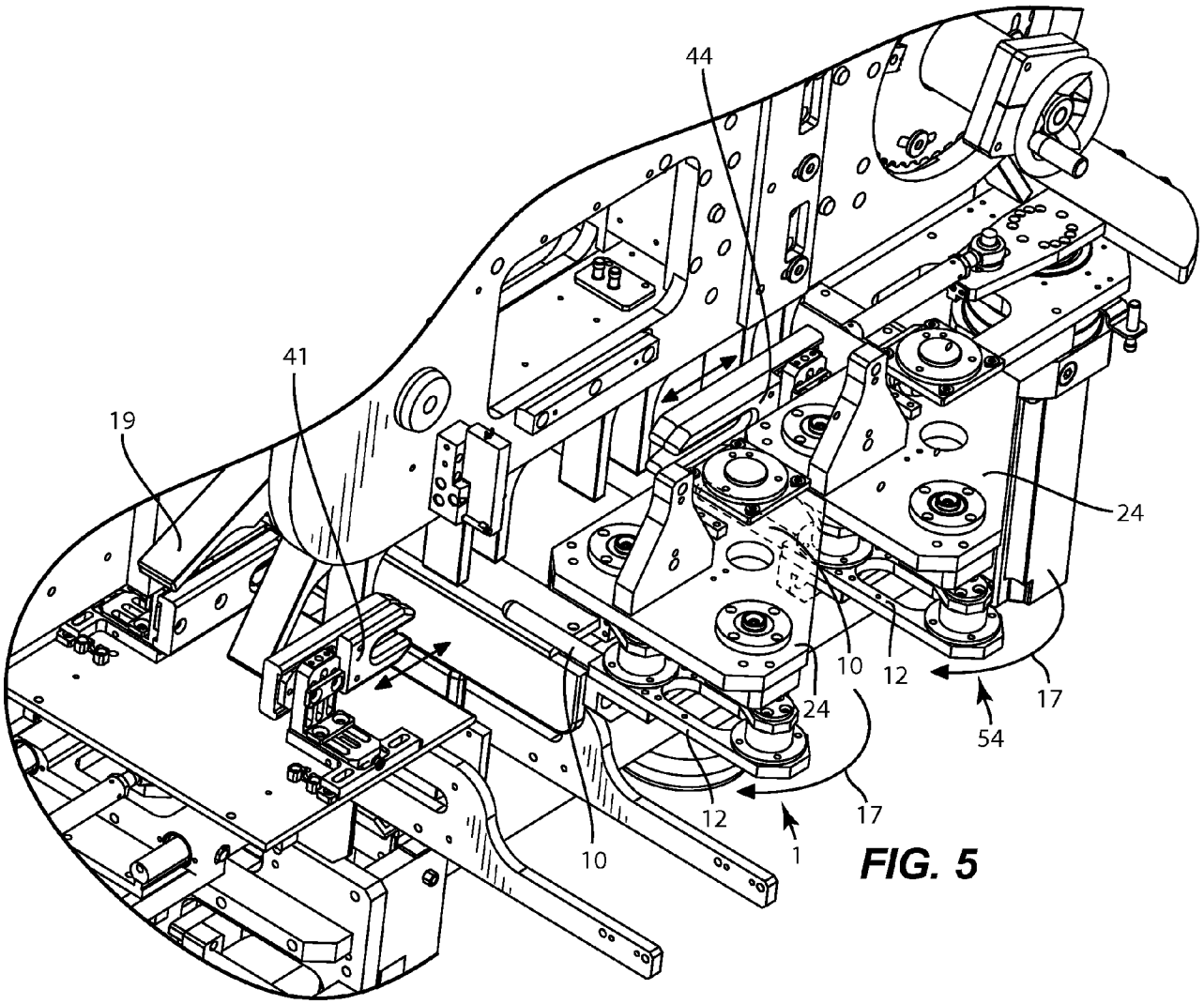
FIG. 5 depicts another embodiment of a roll packaging system and method including two rotating tucking devices

In the embodiment depicted in FIG. 5, the second, or downstream, tucking device 54 is a rotating tuck device 1. In such an embodiment, the second tuck step 79 is a moving tuck step like the moving first tuck step 76. The second tucking device 54 may be identical to the first device, or its design may be adjusted along the lines described herein according to the needs in the roll wrapping system 40. The benefit of having the second tuck step 79 as a moving tuck step would be that the roll continues to move throughout the second folding step 78 and the second tuck step 79. Thereby, the roll wrapping system 40 with a moving second tuck step may be faster and more efficient than an embodiment having a stationary second tuck step.

Like the head folding plate 41, the tail folding plate 44 may be any shape that accommodates the coordinated folding step, i.e. 75 or 78, and tuck step, i.e. 76 or 79. In the embodiment of FIG. 5, the tail folding plate 44 is a backwards C shape to accommodate the moving second tucking arm 55. In another embodiment, the folding plate, e.g. the head plate 41 or the tail folding plate 44, may be shaped to approach the roll from the top and/or side angles, and thereby fold the top and/or side portions of the wrapper 6 over the end 5 of the roll. For example, the plate 41 or 44 may be an L shape that spans over the top and side portions of the roll end 5. In another embodiment, the plate may be a diagonally positioned bar that spans over the top and side portions of the roll end 5. Alternatively, the head plate may approach the roll only from the side. A separate plate could then be used, if necessary, to fold the wrapper 6 over the top side of the roll end 5.

If the folding step is a separate step that takes place prior to the tuck step, the folding plate, i.e. 41 or 44, may be a solid rectangular plate with no indentions to accommodate the second tucking arm 55. However, in the embodiment where the folding step overlaps significantly with the tuck step, the tail folding plate 44 may be two separate plates that split the hollow cavity 4 such that the tail folding plate would never cross over the hollow cavity 4 or impede the motion of a moving second tucking arm 55.

Figure 6:
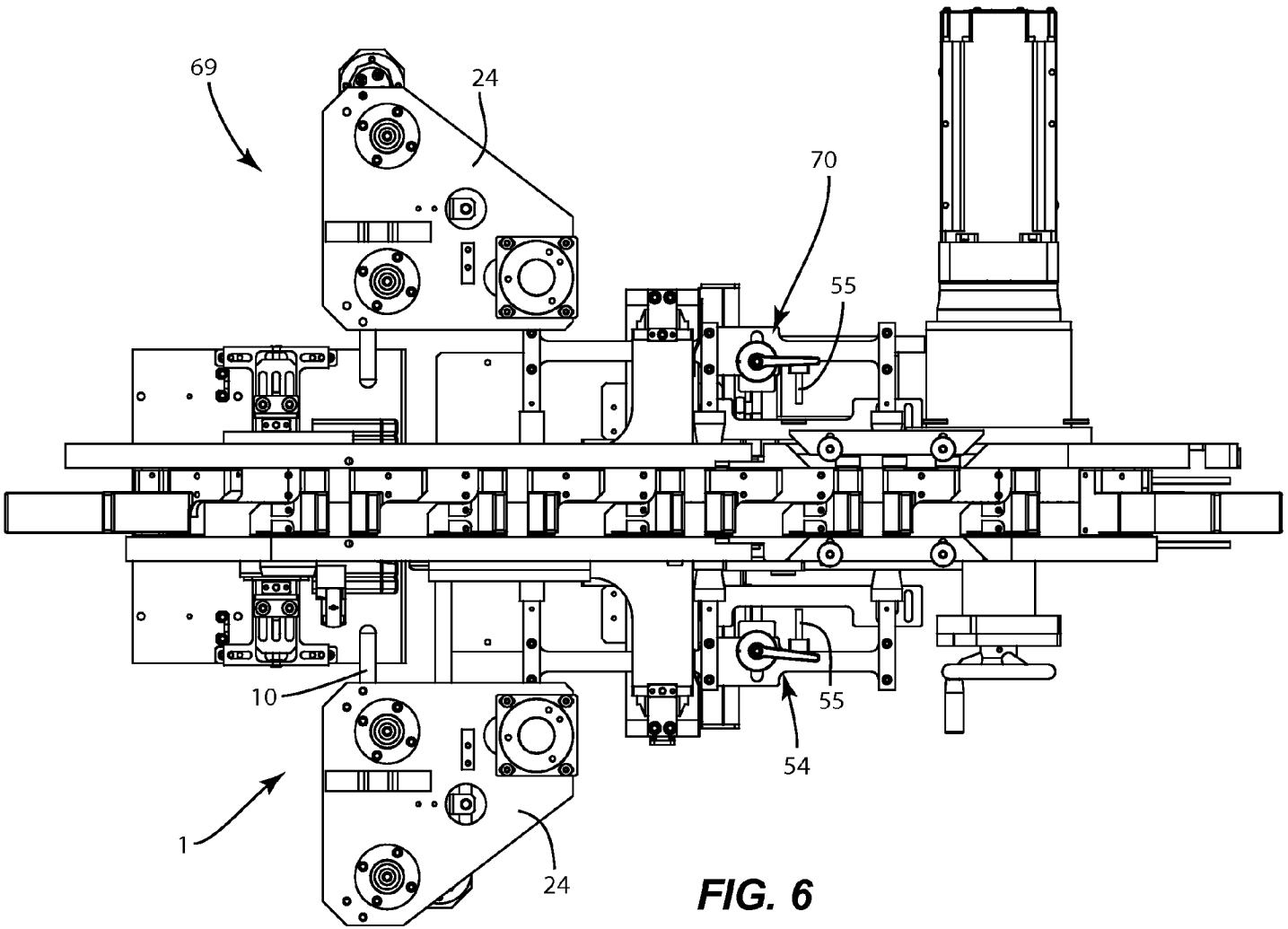
FIG. 6 depicts a top view of an embodiment of a roll packaging system having four tucking arms, two on each side of the roll.

As depicted in FIG. 6, two rotating tucking devices 1 and 69 may be positioned adjacent to either end 5*a* and 5*b* of the roll 2 to insert the wrapper 6 into both ends of the roll 2 simultaneously. Likewise, two second, or downstream, tucking devices 54 and 70 can be positioned downstream from the first rotating tucking devices. Specifically, a second tucking device 54 may be positioned to tuck the wrapper 6 into the first roll end 5*a*, and an opposing second tucking device 70 may be positioned to tuck the wrapper 6 into the second end 5*b* of the roll. The second tucking device 54 and the opposing second tucking device 70 may operate to simultaneously execute a second tuck step 79, or they may execute their respective tucking actions sequentially. As is thoroughly described above, the second, or downstream, tucking devices 54 and 70 may be rotating tucking devices 1 that execute a moving tuck step (FIG. 5) or stationary tucking devices that execute a stationary tuck step (FIG. 4).

This written description uses examples to disclose the invention, and to enable any person skilled in the art to make and use the invention. The patentable scope of the invention is defined by the claims, and may include other example that occur to those skilled in the art. Such other example are intended to be within the scope of the claims if they have structural elements that do not differ from the literal language of the claims, or if they include equivalent structural elements with insubstantial differences from the literal language of the claims.

We claim:

1. A rotating tucking device for securing a wrapper to a roll in a roll packaging system, the rotating tucking device comprising:

a tucking arm for insertion into a hollow cavity of a roll; and a rotating insertion system including at least one crank for moving the tucking arm in a circular rotational pattern coordinated with the movement of the roll through the roll packaging system such that the tucking arm tucks a wrapper into the hollow cavity of the roll as the roll moves continuously through the roll packaging system;

wherein the circular rotational pattern and the movement of the roll through the roll packaging system are coplanar.

2. The rotating tucking device of claim 1, wherein the rotating insertion system places the tucking arm at a start position adjacent to the hollow cavity of the roll;

inserts the tucking arm into the hollow cavity of the roll;

maintains the tucking arm in the hollow cavity of the roll as the roll moves through the roll packaging system;

removes the tucking arm from the hollow cavity of the roll; and returns the tucking arm to the start position.

3. The rotating tucking device of claim 1 wherein the rotating insertion system further comprises:

a support bar having a front end and a back end, the front end connected to the tucking arm;

at least one rotating joint connected to the support bar;

wherein the at least one crank is connected to the support bar via the rotating joint; and a drive system connected to the crank to drive the crank, the support bar, and the tucking arm in a circular motion.

4. The rotating tucking device of claim 3 wherein the rotating insertion system further comprises:

a linkage system having a first crank connected to the front end of the support bar at a rotating first joint and a second crank connected to the back end of the support bar at a second rotating joint; and the first and second cranks further connected to the drive system such that the cranks are driven simultaneously in the circular motion.

5. The rotating tucking device of claim 4 wherein the drive system includes:

three rotational pulleys positioned in a triangular pattern, including a driver pulley and two driven pulleys, wherein each of the driven pulleys is connected to one of the first and second cranks;

a driver belt encircling and connected to the rotational pulleys such that the driver belt forms a triangular shape; and a motor connected to the driver pulley to rotate the driver pulley and move the driver belt, such that the first and second cranks are simultaneously driven in the circular motion.

6. The rotating tucking device of claim 1 wherein the roll is a roll of toilet paper and the wrapper is paper.

7. The rotating tucking device of claim 1 further comprising at least one additional tucking arm connected to the rotating insertion system and moving in the circular rotational pattern to tuck a wrapper into a hollow cavity of a second roll moving continuously through the roll packaging system.

8. A rotating tucking device for securing a wrapper to a roll in a roll packaging system, the device comprising:

a tucking arm for insertion into a hollow cavity of a roll;

a rotating insertion system connected to the tucking arm for moving the tucking arm in a circular rotational pattern coordinated with the movement of the roll through the roll packaging system such that the tucking arm and the rotating insertion system tuck a wrapper into the hollow cavity of the roll as the roll moves continuously through the roll packaging system; and the rotating insertion system having at least one crank rotated in a circular motion and operatively connected to the tucking arm via a rotating joint to move the tucking arm in the circular rotational pattern.

9. The rotating tucking device of claim 8 wherein the rotating insertion system places the tucking arm at a start position adjacent to the hollow cavity of the roll;

inserts the tucking arm into the hollow cavity of the roll;

maintains the tucking arm in the hollow cavity of the roll as the roll moves through the roll packaging system;

removes the tucking arm from the hollow cavity of the roll; and returns the tucking arm to the start position.

10. The rotating tucking device of claim 8 wherein the rotating insertion system further comprises:

a support bar having a front end and a back end, the front end connected to the tucking arm;

the at least one crank connected to the support bar via the rotating joint; and a drive system connected to the crank to drive the crank, the support bar, and the tucking arm in the circular motion.

11. The rotating tucking device of claim 10 wherein the rotating insertion system further comprises:

a first crank connected to the front end of the support bar at a rotating first joint and a second crank connected to the back end of the support bar at a second rotating joint; and the first and second cranks further connected to the drive system such that the cranks are driven simultaneously in the circular motion.

12. The rotating tucking device of claim 11 wherein the drive system includes:

three rotational pulleys positioned in a triangular pattern, including a driver pulley and two driven pulleys, wherein each of the driven pulleys is connected to one of the first and second cranks;

a driver belt encircling and connected to the rotational pulleys such that the driver belt forms a triangular shape; and a motor connected to the driver pulley to rotate the driver pulley and move the driver belt, such that the first and second cranks are simultaneously driven in the circular motion.

13. The rotating tucking device of claim 8 wherein the roll is a roll of toilet paper and the wrapper is paper.

14. The rotating tucking device of claim 8 further comprising at least one additional tucking arm connected to the rotating insertion system and moving in the circular rotational pattern to tuck a wrapper into a hollow cavity of a second roll moving continuously through the roll packaging system.

* * * * *